United States Patent [19]

Mitchell

[11] 4,210,674

[45] Jul. 1, 1980

[54] AUTOMATICALLY VENTABLE SEALED FOOD PACKAGE FOR USE IN MICROWAVE OVENS

[75] Inventor: Richard P. Mitchell, Neenah, Wis.

[73] Assignee: American Can Company, Greenwich, Conn.

[21] Appl. No.: 971,318

[22] Filed: Dec. 20, 1978

[51] Int. Cl.[2] ..... B65D 51/16; H05B 9/00

[52] U.S. Cl. ..... 426/107; 219/10.55 E; 229/3.5 MF; 229/DIG. 14; 426/113; 426/118; 426/234

[58] Field of Search ..... 426/107, 113, 118, 234, 426/395, 114; 219/10.55 E, 10.55 M; 229/3.5 MF, 65, DIG. 14

[56] References Cited

U.S. PATENT DOCUMENTS

| | | | |
|---|---|---|---|
| 2,633,284 | 3/1953 | Moffett et al. | 426/113 X |
| 3,219,460 | 11/1965 | Brown | 426/107 |
| 3,353,968 | 11/1967 | Krajewski | 426/107 |
| 3,398,041 | 8/1968 | Ferree | 229/3.5 MF |
| 3,410,697 | 11/1968 | Stephenson | 426/114 |
| 3,754,371 | 8/1973 | Walker | 229/65 |
| 3,777,099 | 12/1973 | Levinson | 219/10.55 E |
| 3,941,967 | 3/1976 | Sumi et al. | 219/10.55 E |
| 3,997,677 | 12/1976 | Hirsch et al. | 426/113 |
| 4,013,798 | 3/1977 | Goltsos | 426/107 |

*Primary Examiner*—Steven L. Weinstein

*Attorney, Agent, or Firm*—Robert P. Auber; George P. Ziehmer; Harry W. Hargis

[57] ABSTRACT

A refrigerated food is packaged in a paperboard tray covered by a plastic film bonded to upper edges of the tray sidewalls in provision of a barrier against contamination of the food. The film and the tray are transparent to microwave energy for heating the food, and automatic venting of the covered tray, while heating, is afforded by a relatively small strip of electrically conductive material on the film and absorptive of microwave energy in an amount sufficient to heat the same and melt a vent opening in the film.

12 Claims, 5 Drawing Figures

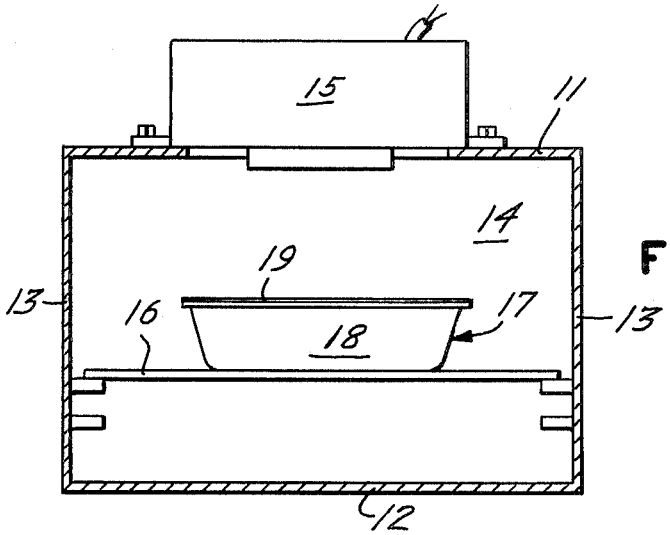
FIG. 1
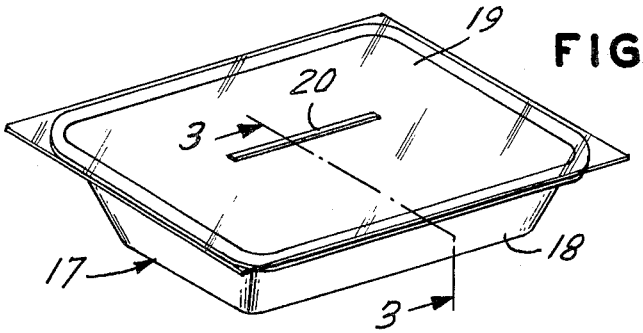
FIG. 2
FIG. 3
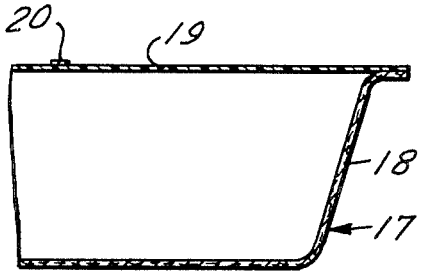
FIG. 4
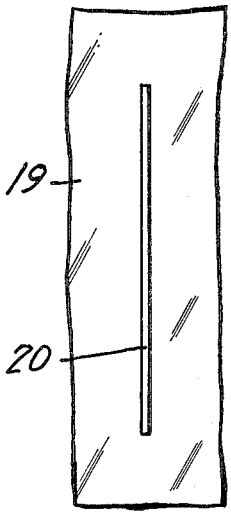
FIG. 5
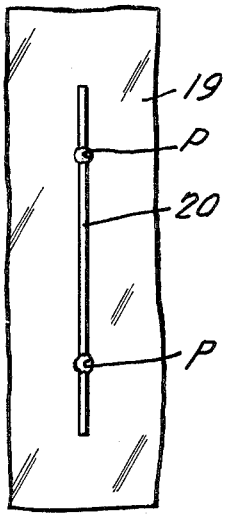

AUTOMATICALLY VENTABLE SEALED FOOD PACKAGE FOR USE IN MICROWAVE OVENS

BACKGROUND OF THE INVENTION

This invention relates to packaging structure, and more particularly to packaging structure for foods affording refrigerated storage and subsequent heating to prepare the food for serving.

In the preparation of refrigerated packaged food for serving in a heated state, it has been a practice to place the packaged food in a microwave oven to heat the same. Heating may be either for the purpose of thawing and cooking frozen food or for thawing and heating cooked foods. In either event, considerable water vapor pressure is generated, and since packages are usually well sealed while stored, precautions must be taken to ensure against sudden explosion of the package resulting possibly in damage to the oven or even injury to the user. One useful structure for packaging foods of the aforementioned type comprises a tray including bottom an side walls, and a transparent film of plastic material stretched over and sealed to the side wall. Venting such packages has, in the past, involved provision of means for venting in response to water vapor pressure build-up. Such means could, of course, in themselves vent with a suddeness resulting in food leakage. An example of a pressure responsive vent is found in U.S. Pat. No. 4,013,798 believed material to the examination of this application. The patent discloses a food tray 10, a cover 31 sealed thereover, and a vent notch 32 in the tray in the region of the cover seal. Presence of notch 32 weakens the seal so that it will rupture upon build-up of water vapor pressure.

U.S. Pat. No. 3,353,968 also is believed material to the examination of this application in its teaching of a food package 54 provided with conductive strips 62 for concentrating microwave energy in the packaged food.

It is an objective of the present invention to provide improved automatic venting means for a sealed food package adapted to undergo heating by microwave energy.

It is a further objective of the invention to provide improved venting means for a sealed food package operable automatically upon subjection of the package and its contents to heating by microwave energy.

It is a still further objective of the invention to provide improved venting means for a sealable food package adapted to undergo heating by microwave energy, which venting means is provided automatically upon heating and independently of pressure build-up.

SUMMARY OF THE INVENTION

In achievement of the foregoing as well as other objectives and advantages, the invention contemplates a package comprising a container formed from a dielectric material transparent to microwave energy, a cover formed from a dielectric material transparent to microwave energy extending over and hermetically sealed to said container, and a relatively small body of material on said cover effective to heat and vent said cover in the presence of microwave energy for heating the package.

The manner in which the foregoing as well as other objectives and advantages of the invention may best be achieved will be more fully understood from a consideration of the following description, taken in light of the accompanying drawing.

BRIEF DESCRIPTION OF THE DRAWING

FIG. 1 is an elevational showing, partly in section of a microwave oven and a food package embodying the invention;

FIG. 2 is a perspective showing of a food package embodying the invention;

FIG. 3 is a fragmentary sectional showing taken along the lines 3—3 in FIG. 2, looking in the direction of arrows applied thereto;

FIG. 4 is a fragmentary top plan view of a portion of the package seen in FIG. 2; and FIG. 5 is a view similar to FIG. 4, and illustrating an operational feature of the invention.

DESCRIPTION OF THE PREFERRED EMBODIMENT

With more detailed reference to the drawing, and first to FIG. 1, a microwave oven 10 of conventional design includes top, bottom, side, and end walls 11, 12, 13 and 14, respectively, and a suitable access door (not shown), cooperably disposed to define a high "Q" resonant cavity. Microwave energy is supplied to the cavity by a microwave generator or power pack 15 conveniently disposed upon top wall 11. A shelf 16 is provided within oven 10 and is so positioned as to support a food package 17 to be heated by the microwave energy.

In particular accordance with the invention, and with reference to FIG. 2, package 17 conveniently is of the type including a flanged-edge, dielectric paperboard tray 18 for holding refrigerated food (not shown) and hermetically sealed by a film 19 of dielectric polymeric material adherent to flanged edges of the tray.

Package 17 is of the so-called heat-in type, and, according to the present invention, is provided with means for automatically venting its contents to atmosphere upon heating in a microwave oven. With reference also to FIG. 3, the means for venting comprises a narrow strip 20 of material, such as, for example, aluminum foil. One satisfactory combination of cover film 19 and strip 20 comprises a film of about 20 gauge (0.002 inches) polyester, such as, for example, polyethylene terephthalate, provided with a strip of about 25 gauge aluminum foil that is about $2\frac{1}{8}$ inches long and about 1/32 inch wide. Cover film 19 is applied to tray 18 using typical heat sealing techniques, and it has been found convenient to apply foil strip 20 to the film using an adhesive in-line with the heat seal application of film 19 to the tray.

While metal or electrically conductive materials are known to reflect microwave energy, and particularly in the frequency of about 2,450 Megahertz commonly used in microwave ovens of the type disclosed, it has been found that when these materials are of certain dimensions they convert microwave energy to heat. Conductive strip 20 was found to perform satisfactorally in a number of generally rectangular configurations ranging from 1/64 inch to 6 inches in length and from 1/64 inch to 1 inch in width. Optimum results were achieved for a length of $1\frac{1}{8}$ inches$\pm\frac{1}{8}$ inch, and a width of 1/32 inch $\pm$1/64 inch. This length ($2\frac{1}{8}$ inches) is about one-half wave length at 2,450 Megahertz. Food packages embodying the invention have been successfully vented at microwave oven power settings of 600, 700 and 1,400 Watts, wherein venting has occurred within about 1 to 20 seconds of initiation of the heating period.

Considering as a starting condition the structure seen in FIG. 4, venting occurs as one or more small perforations P, as seen to advantage in FIG. 5, created by melting of the sheet 19 in the region of hot spots developed along the strip 20. Temperature of these hot spots is considered sufficient to melt the film 19. Complete melting of the sheet underlying the strip 12 is thought not to occur because fragmenting of the conductive strip into lesser lengths destroys a major portion of the heat generating characteristics of the strip. All that is desired for venting is, of course, a small opening which is ensured by the preferred dimensions of strip 20 as described.

Another material found suitable for film 19 is the polyester of ethylene glycol and terephthalic acid, available under the trademark MYLAR, preferably from about 48 gauge to about 92 gauge in thickness. Other materials suitable for strip 20 comprise conductive coatings, such as, for example, silver micropaint, having an electrical resistance of from about 0.1 to about 0.5 ohm per inch, and available from the Micro-Circuits Co. Another such material comprises a copper-filled coating having an electrical resistance of from about 0.0005 to about 0.001 ohm-cm, and available from Electro-Kinetic Systems, Inc. These conductive materials comprise dispersions of metal powder, and can be applied by brushing, spraying, dipping, flowing, or printing. Also, these materials can be applied to the lid material at the same time as the heat seal coating, using, for example, a printing wheel or a spray applicator.

While a preferred embodiment and modifications thereof have been described, it is to be understood that other changes can be made, as is evident from the scope of the appended claims.

I claim:

1. A refrigerated food package capable of being heated in a microwave oven, said package comprising dielectric receptacle means and dielectric cover means hermetically sealed thereover to accommodate heating of food contained therein by microwave energy, and means for venting said package automatically in response to its subjection to microwave energy, said means for venting including a strip of electrically conductive material on said cover means so shaped and dimmensioned as to be heated by said microwave energy, upon heating said package, in an amount effective to produce a venting perforation in said cover means wherein said cover means is of a meltable material and the heat content of said strip of electrically conductive material is effective to raise the temperature of the underlying portion of the cover means to melt the latter in production of said venting.

2. A package according to claim 1, wherein said cover means comprises a film of polymeric material, and said body of material comprises a strip of metal foil adherent to a surface of said film.

3. A package according to claim 1 or 2, wherein said cover means comprises a film of polymeric material selected from the group consisting of polyethylene terephthalate and the polyester of ethylene glycol and terephthalic acid.

4. A package according to claim 3, wherein said strip of metal foil comprises aluminum about 35 gauge in thickness, from about 2 inches to about 2¼ inches in length, and from about 1/64 to about 3/64 inch in width, and said polymeric material comprises polyethylene terephthalate about 20 gauge in thickness.

5. A package according to claim 3, wherein said strip of metal foil comprises aluminum about 35 gauge in thickness, from about 2 inches to about 2¼ inches in length, and from about 1/64 to about 3/64 inch in width, and said polymeric material comprises the polyester of ethylene glycol and terephthalic acid from about 48 gauge to about 92 gauge in thickness.

6. A package according to claim 1, wherein said cover means comprises a film of polyester material and said body of electrically conductive material comprises a strip of metal.

7. A package according to claim 6, wherein said metal comprises aluminum foil adherent to the surface of said film.

8. A package according to claim 6, wherein said metal comprises a dispersion of metal powder adherent to said film.

9. A package according to claim 6, wherein said strip of metal is from about 2 inches to about 2¼ inches in length and from about 1/64 inch to about 3/64 in width.

10. A package according to claim 6, wherein said film of polyester is from about 20 gauge to about 92 gauge in thickness and said body of electrically conductive material comprises a relatively thin strip of metal about ½ wave long.

11. A package according to claim 6, wherein said strip of metal is from about 1/64 inch to about 6 inches in length and from about 1/64 inch to about 1 inch in width.

12. A package according to claim 8, where said metal powder comprises copper or silver.

* * * * *